US010043329B2

(12) United States Patent
Murray et al.

(10) Patent No.: US 10,043,329 B2
(45) Date of Patent: Aug. 7, 2018

(54) DETECTION AND PROTECTION AGAINST JAM INTERCEPT AND REPLAY ATTACKS

(71) Applicant: Ford Global Technologies, LLC, Dearborn, MI (US)

(72) Inventors: Allen R. Murray, Lake Orion, MI (US); Oliver Lei, Windsor (CA)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/278,971

(22) Filed: Sep. 28, 2016

(65) Prior Publication Data

US 2018/0089918 A1 Mar. 29, 2018

(51) Int. Cl.
*G07C 9/00* (2006.01)

(52) U.S. Cl.
CPC ..... *G07C 9/00309* (2013.01); *G07C 9/00007* (2013.01); *G07C 2009/00555* (2013.01)

(58) Field of Classification Search
None
See application file for complete search history.

(56) References Cited

U.S. PATENT DOCUMENTS 5,369,706 A * 11/1994 Latka ..... G07C 9/00182 340/11.1
6,169,492 B1 1/2001 Dabbish
6,424,056 B1 7/2002 Irvin
9,008,917 B2 4/2015 Gautama et al.
9,166,730 B2 10/2015 Van Wiemeersch
2003/0062996 A1* 4/2003 Flanagan ..... B60R 99/00 340/457
2007/0018812 A1* 1/2007 Allen ..... G08B 21/0202 340/539.13
2007/0200688 A1 8/2007 Tang et al.
(Continued)

FOREIGN PATENT DOCUMENTS

CN 102923094 A 2/2013
CN 105298233 A 3/2016
DE 202006016181 U1 12/2006
(Continued)

OTHER PUBLICATIONS

J-Alert Tracking and Communications Jammer Detector/Locator. Dyplex Communications Ltd., Jan. 8, 2014.
(Continued)

*Primary Examiner* — Joseph Feild
*Assistant Examiner* — John Mortell
(74) *Attorney, Agent, or Firm* — James P. Muraff; Neal, Gerber & Eisenberg LLP

(57) ABSTRACT

Method and apparatus are disclosed for detection and protection against jam intercept and replay attacks. An example disclosed key fob includes a first wireless transceiver tuned to communicate via a first frequency band, second wireless transceiver tuned to communicate via a second frequency band, and a communicator. The first frequency band is different than the second frequency band. The example communicator sends a first message via the first wireless transceiver in response to activation of a first button. Additionally, the example communicator, in response to not receiving a second message via the second wireless transceiver, provides an alert.

23 Claims, 5 Drawing Sheets

(56) References Cited

U.S. PATENT DOCUMENTS

| | | | | |
|---|---|---|---|---|
| 2015/0150116 | A1* | 5/2015 | Baldwin | G06F 21/32 726/16 |
| 2015/0287257 | A1* | 10/2015 | Thompson | G07C 9/00309 340/5.72 |

FOREIGN PATENT DOCUMENTS

| | | | |
|---|---|---|---|
| FR | 2955958 | A1 | 8/2011 |
| JP | 2006307638 | | 11/2006 |
| WO | WO 2014/056004 | A1 | 4/2014 |

OTHER PUBLICATIONS

Search Report dated Feb. 28, 2018 for GB Patent Application No. 1715340.4 (4 Pages).

* cited by examiner

DETECTION AND PROTECTION AGAINST JAM INTERCEPT AND REPLAY ATTACKS

TECHNICAL FIELD

The present disclosure generally relates to remote keyless entry and, more specifically, to detection and protection against jam intercept and replay attacks.

BACKGROUND

A remote keyless entry system facilitates unlocking doors of a vehicle using a key fob. They key fob send a message that includes an authentication token and a counter value to a wireless receiver coupled to a body control module. The body control module unlocks the doors if the authentication token and the counter value are valid. Because the driver may press a button on the key fob when the key fob is out of range of the vehicle, the counter value is valid if it is within an acceptable range of an expected value. To break into a vehicle, a hacker (a) jams the radio frequency used by the remote keyless entry system so that a first message is not received by the wireless receiver, and (b) intercepts the first message with the authentication token and a first valid counter value. Thinking that the wireless receiver may not have been in range, often the driver presses the button on the key fob again. The key fob sends a second message with the authentication token and a second value counter value. The hack intercepts the second message and broadcasts the first message to the vehicle. As a result, the hacker obtains the second message that may be used to unlock the vehicle door at a later time when the driver is not present. This is referred to as a jam intercept and replay attack.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are disclosed for detection and protection against jam intercept and replay attacks. An example disclosed key fob includes a first wireless transceiver tuned to communicate via a first frequency band, second wireless transceiver tuned to communicate via a second frequency band, and a communicator. The first frequency band is different from the second frequency band. The example communicator sends a first message via the first wireless transceiver in response to activation of a first button. Additionally, the example communicator, in response to not receiving a second message via the second wireless transceiver, provides an alert.

An example disclosed method includes establishing a connection to a vehicle, via a first wireless transceiver, using a first frequency band. The example method also includes sending a first message, via a second wireless transceiver tuned to communicate via a second frequency band, in response to activation of a first button. The first and second frequency bands are different. Additionally, the method includes, in response to not receiving a second message via the first wireless transceiver, providing an alert.

A computer readable medium comprising instruction that, when executed, cause a key fob to establish a connection to a vehicle, via a first wireless transceiver, using a first frequency band. The instructions also cause the key fob to send a first message, via a second wireless transceiver tuned to communicate via a second frequency band, in response to activation of a first button, the first and second frequency bands being different. Additionally, the instructions also cause the key fob to, in response to not receiving a second message via the first wireless transceiver, provide an alert.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
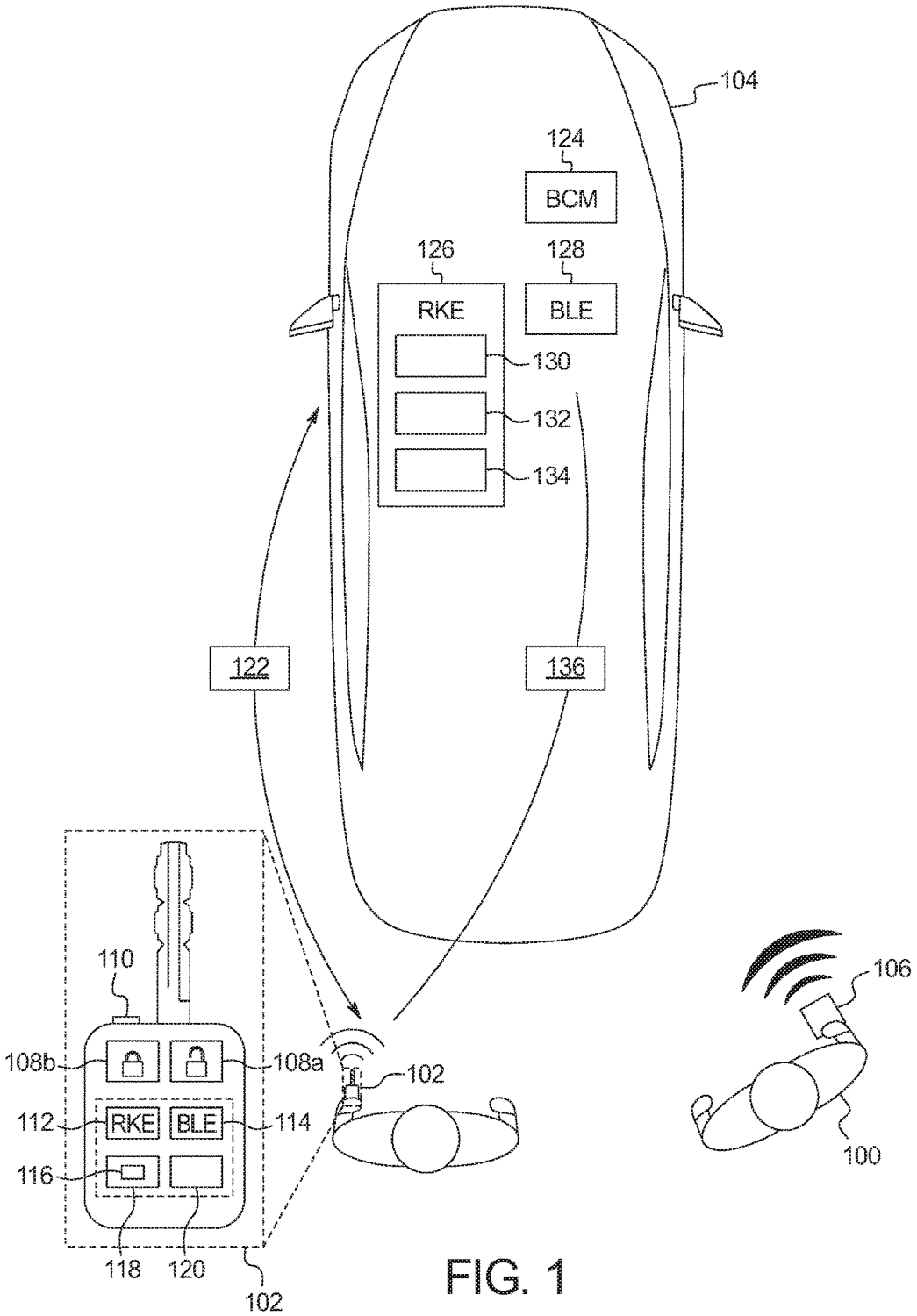
FIG. 1 illustrates a system to detect and protect against jam intercept and replay attacks that operates in accordance with the teaching of this disclosure.

While the invention may be embodied in various forms, the drawings will show and hereinafter describe some exemplary and non-limiting embodiments, with the understanding that the present disclosure is to be considered an exemplification of the invention and is not intended to limit the invention to the specific embodiments illustrated.

Historically, hackers used tools to intercept and replay authentication tokens for vehicles and garage doors. To counter these tools, the remote keyless entry systems include a system of rolling codes, in which the key fob's code changes with every use and any code is rejected if it's used a second time. To overcome the rolling codes, hackers deploy the jam intercept and replay attack The first time the driver presses their key fob, a hacking device jams the signal with radios that broadcast high amplitude noise on the frequencies (e.g., 315 MHz, etc.) used by vehicle remote keyless entry systems. At the same time, the hacking device listens with an additional radio and records the user's wireless code. The additional radio is more finely tuned to pick up the signal from the key fob than the actual intended receiver of the vehicle. When that first signal fails to unlock the door because it is jammed, the driver presses the button on the key fob again. On that second press, the hacking device again jams the signal and records the second code, while simultaneously broadcasting the first code. The first code unlocks the door and the driver forgets about the failed key press. However, the second code is still usable. When the driver exits the vehicle, the hack may use the second code to enter the vehicle.

As disclosed herein below, the remote keyless entry system and/or the key fob detects indications that communication between the remote keyless entry system is being jammed. As used herein "jamming" refers to the use of a radio signal tuned to the same frequency as the targeted receiver that overpowers the signals intended for the targeted receiver. When the remote keyless entry system and/or the key fob detects an indication, the remote keyless entry system and/or the key fob reacts to alert the driver and/or mitigate the possible attack. In some examples, the remote keyless entry system detect an indication of the hacking device when a signal strength broadcast on frequency used by the remote keyless entry system is abnormally strong. Alternatively or additionally, in some examples, the remote keyless entry system and the key fob include short range wireless nodes that are securely paired (e.g., via a setup process). For example, the short range wireless nodes may include hardware and firmware to implement Bluetooth® Low Energy. In such examples, when the button is pressed on the key fob and received by the remote keyless entry system, the remote keyless entry system sends a confirmation via the short range wireless node. If the key fob detects an indication of the hacking device when it does not receive the confirmation via the short range wireless node. Additionally or alternatively, when the key is inserted into ignition, the remote keyless entry system compares the last rolling code transmitted by the key fob (e.g., as stored in memory of the key fob) with last received rolling code received from the key fob (e.g., as stored in memory of the remote keyless entry system). When the two rolling codes do not match, the remote keyless entry system detects an indication of the hacking device.

When an indication of the hacking device is detected, the remote keyless entry system and/or the key fob provide an alert to the driver. Additionally or alternatively, in some examples, this resynchronizes the rolling codes of the remote keyless entry system and or the key fob. To resynchronizes the rolling codes, the remote keyless entry system (i) randomly or pseudo-randomly generates a new rolling code value, or (ii) changes a portion of the rolling code value.

FIG. 1 illustrates a system to detect and protect against a hacker 100 using jam intercept and replay attacks that operates in accordance with the teaching of this disclosure. In the illustrated example, the system includes a key fob 102 and a vehicle 104. The hacker 100 may be any person or entity that, remotely or in person, uses a jam and intercept device 106 to (a) jam radio communication between the vehicle 104 and the key fob 102, and (b) intercept the radio communication from the key fob. The vehicle 104 and a key fob 102 communicate via a specified radio frequency band. For example, the radio frequency band may be centered on 315 MHz or 433.92 MHz. The particular radio frequency band may be specified by a governmental organization.

The jam and intercept device 106 includes one or more radios tuned to the specified radio frequency band. To jam communication, the jam and intercept device 106 broadcasts a signal from the radios on the specified radio frequency band to overpower the signal between the vehicle 104 and the key fob 102. The jam and intercept device 106 also includes an additional radio tuned to the specified radio frequency band. The additional radio is more finely tuned to pick up the signal from the key fob 102 than the actual intended receiver of the vehicle 104. This additional radio receives a first message on the radio frequency band from the key fob 102 that contains an authentication token and a first counter value. The jam and intercept device 106 stores the intercepted first message in memory. When a second message that contains the authentication token and a second counter value is received, the jam and intercept device 106 (a) stores the second message in memory and (b) transmits the first message over the one or more radio jamming communication. Traditionally, because the first message from the jam and intercept device 106 overpowers the second messages, the vehicle 104 is unaware that a second attempt has been made.

The key fob 102 is configured to remotely instruct the vehicle 104 to lock and unlock its doors. In the illustrated example, the key fob includes buttons 108*a* and 108*b*, a light emitting diode (LED) 110, a remote keyless entry (RKE) node 112, a short-range wireless module 114, a communicator 116, a processor or controller 118, and memory 120. The buttons 108*a* and 108*b* provide an input interface that a user may push to instruct the key fob 102 to perform various functions. The buttons include a lock button 108*a* and an unlock button 108*b* to cause the key fob to send a RKE message 122 with a lock command or an unlock command respectively. The key fob 102 may also include other buttons (not shown), such as an alarm button and/or a trunk release button. The LED 110 may be an LED of any suitable color, such as red or blue. In some examples, the LED 110 may be an RGB LED that may, based on electrical input, produce different colors.

The RKE node 112 includes a radio transmitter and an antenna to broadcast the RKE message 122. The radio transmitter is configured to have a range of approximately 15 feet to 50 feet. Additionally, the radio transmitter is tuned to a particular operating frequency. For example, the operating frequency may be 315 MHz (for North America) or 433.92 MHz (for Europe). The short-range wireless module 114 includes the hardware and firmware to establish a connection with the vehicle 104. In some examples, the short-range wireless module 114 implements the Bluetooth and/or Bluetooth Low Energy (BLE) protocols. The Bluetooth and BLE protocols are set forth in Volume 6 of the Bluetooth Specification 4.0 (and subsequent revisions) maintained by the Bluetooth Special Interest Group. The short-range wireless module 114 operates on a frequency different from the RKE node 112 and facilitates two-way communication. For example, the radio transmitter of the short-range wireless module 114 may be tuned to 2.4 GHz. The short-range wireless module 114 bonds with a short-range wireless module (e.g., the short-range wireless module 128 below) of the vehicle 104 during, for example, an pairing process through an infotainment system of the vehicle 104. During the pairing process, the short-range wireless module 114 exchange an initial authentication token (e.g., a shared key). After the pairing process, the short-range wireless module 114 exchange, based on the initial authentication token, a session authentication token (e.g., a session key) so that message exchanged with vehicle 104 are encrypted. In such a manner, the key fob 102 may communicatively couple with the vehicle 104 using a separate frequency and protocol than the RKE node 112.

Figure 2:
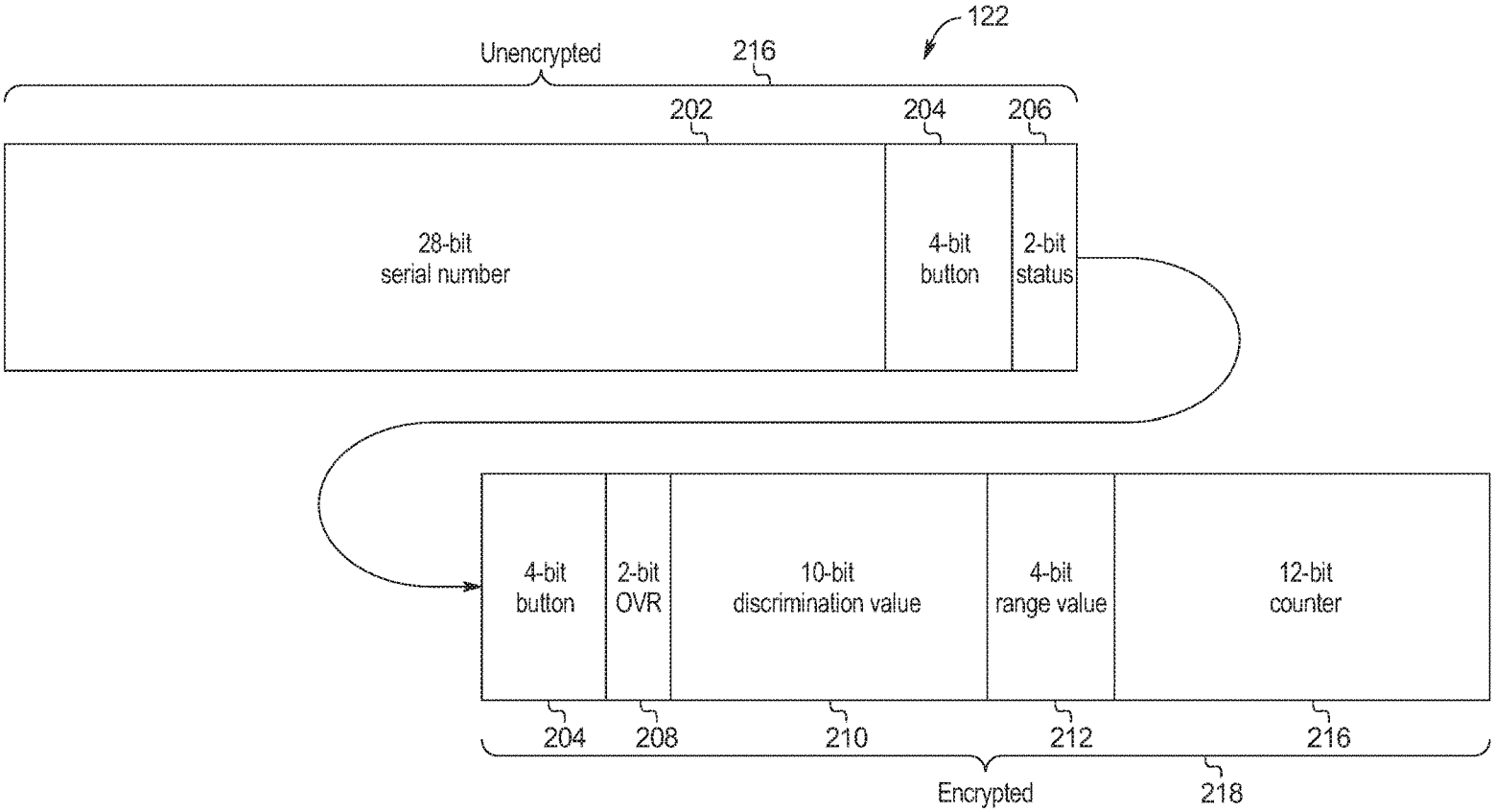
FIG. 2 depicts a remote keyless entry message sent from the key fob to the vehicle of FIG. 1.

The communicator 116 broadcasts the RKE message 122, via the RKE node 112, in response to the key fob 102 receiving input from one of the buttons 108*a* and 108*b*. FIG. 2 depicts an example structure of the RKE message 122 generated by the communicator 116. In the illustrated example, the RKE message 122 includes a serial number 202, a button command 204, a status indicator 206, an overflow value 208, a discrimination value 210, a range value 212, and a counter value 214. Additionally, the RKE message 122 includes an unencrypted portion 216 and an encrypted portion 218. The serial number 202 identifies the key fob 102. The serial number 202 is registered with the vehicle 104 that key fob 102 is to interact with. In the illustrated example, the serial number 202 is a 28-bit value. The button command 204 identifies which one of the buttons 108*a* and 108*b* was pressed to indicate which function (e.g., lock, unlock, activate alarm, open trunk, etc.) the vehicle 104 is to perform. In the illustrated example, the button command 204 is a 4-bit value. The status indicator 206 indicates a status of the key fob 102. For example, the status indicator 206 may indicate that a battery of the key fob 102 is low. In the illustrated example, the status indicator 206 is a 2-bit value. The overflow value 208 is used, in some examples, to extend the counter value 214. In the illustrated example, the overflow value 208 is a 2-bit value. The discrimination value 210 is provided to facilitate the vehicle 104 determining that the RKE message 122 is valid. In some examples, the discrimination value 210 is a number of least significant bits of the serial number 202. In the illustrated example, the discrimination value 210 is a 10-bit value. The range value 212 is used to determine if the RKE message 122 is valid. In some example, when the key fob 102 and the vehicle 104 resynchronize, the key fob 102 and the vehicle 104 change the range value 212. In the illustrated example, the range value is a 4-bit number. The counter value 214 changes in response to the buttons 108*a* and 108*b* being pushed. In the illustrated example, the counter value is a 12-bit value.

When one of the buttons 108*a* and 108*b* is pressed, the communicator 116 increments the counter value 214. The communicator 116 generates the encrypted portion 218 of the RKE message 122 by encrypting the button command 204, the overflow value 208, the discrimination value 210, the range value 212, and the counter value 214 with an encryption key. The encryption key is generated when the key fob 102 is manufactured. The communicator 116 generates the RKE message 122 with the encrypted portion 218 and the unencrypted portion (e.g., the serial number 202, the button command 204, and the status indicator 206). The communicator 116 broadcasts the RKE message 122 via the RKE node 112.

The processor or controller 118 may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). In the illustrated example, the processor or controller 118 is structured to include the communicator 116. The memory 120 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), unalterable memory (e.g., EPROMs), read-only memory, and/or high-capacity storage devices (e.g., hard drives, solid state drives, etc). In some examples, the memory 120 includes multiple kinds of memory, particularly volatile memory and non-volatile memory. The memory 120 stores the serial number 202, the overflow value 208, the range value 212, the counter value 214, and the encryption key.

The memory 120 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 120, the computer readable medium, and/or within the processor 118 during execution of the instructions.

The terms "non-transitory computer-readable medium" and "computer-readable medium" should be understood to include a single medium or multiple media, such as a centralized or distributed database, and/or associated caches and servers that store one or more sets of instructions. The terms "non-transitory computer-readable medium" and "computer-readable medium" also include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The vehicle 104 may be a standard gasoline powered vehicle, a hybrid vehicle, an electric vehicle, a fuel cell vehicle, and/or any other mobility implement type of vehicle. The vehicle 104 includes parts related to mobility, such as a powertrain with an engine, a transmission, a suspension, a driveshaft, and/or wheels, etc. The vehicle 104 may be non-autonomous, semi-autonomous (e.g., some routine motive functions controlled by the vehicle 104), or autonomous (e.g., motive functions are controlled by the vehicle 104 without direct driver input). In the illustrated example the vehicle 104 includes body control module 124, a remote keyless entry (RKE) module 126 and a short-range wireless module 128.

The body control module 124 controls various subsystems of the vehicle 104. For example, the body control module 124 may control power windows, power locks, an immobilizer system, and/or power mirrors, etc. The body control module 124 includes circuits to, for example, drive relays (e.g., to control wiper fluid, etc.), drive brushed direct current (DC) motors (e.g., to control power seats, power locks, power windows, wipers, etc.), drive stepper motors, and/or drive LEDs, etc. In the illustrated example, the body control module 124 locks and unlocks doors of the vehicle 104 in response to instructions from the RKE module 126. The particular function (e.g., lock, unlock, etc.) is specified in the RKE message 122 (e.g., the button command 204) received from the key fob 102.

The RKE module 126 of the vehicle 104 includes a processor or controller 130 and memory 132. The processor or controller 130 may be any suitable processing device or set of processing devices such as, but not limited to: a microprocessor, a microcontroller-based platform, a suitable integrated circuit, one or more FPGAs, and/or one or more ASICs. The memory 132 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), unalterable memory (e.g., EPROMs), read-only memory, and/or high-capacity storage devices (e.g., hard drives, solid state drives, etc). In some examples, the memory 132 includes multiple kinds of memory, particularly volatile memory and non-volatile memory. The memory 132 stores one or more authorized serial numbers, a vehicle range value, a vehicle counter value, and a historical counter value.

The RKE module 126 includes a receiver 134 tuned to the operating frequency at which the key fob 102 will transmit. For example, the receiver of the RKE module 126 may be tuned to 315 MHz. The RKE module 126 decodes the RKE message 122 that it receives from key fob 102 via the receiver 134. Initially, the RKE module 126 determines whether the serial number 202 included in the unencrypted portion 216 of the RKE message 122 matches one of authorized key fob serial numbers stored in the memory 132. If the serial number 202 matches one of authorized key fob serial numbers, the RKE module 126 decrypts the encrypted portion 218 of the RKE message 122 with a decryption key stored in the memory 132. In some examples, the decryption key is generated when the RKE module 126 is manufactured. The RKE module 126 compares the discrimination value 210 in the RKE message 122 to the serial number 202 to ensure that the RKE message 122 was decrypted correctly. The RKE module 126 compares range value 212 and the counter value 214 of the RKE message 122 to a vehicle range value and a vehicle counter value stored in the memory 132. If (a) the vehicle range value matches the range value 212, and (b) the counter value 214 is within an acceptable range of the vehicle counter value (e.g., the difference between the vehicle counter value and the counter value 214 is less that 128 or 256, etc.), the RKE module 126 instructs the body control module 124 to perform the action specified in the button command 204 of the RKE message 122.

The short-range wireless module 128 includes the hardware and firmware to establish a connection with the key fob. The short-range wireless module 128 implements the same protocol as the short-range wireless module 114 of the key fob 102. During a bonding process, the short-range wireless module 128 exchanges an authentication token with the short-range wireless module 114 of the key fob 102. This facilitates the short-range wireless modules 114 and 128 establishing an encrypted connection in the future without user intervention.

In operation, the RKE module 126 of the vehicle 104 measures a received signal strength of a signal (e.g., the RKE message 122 from the key fob 102, the jamming signal from the jam and intercept device 106, etc.). The RKE module 126 compares the received signal strength to a threshold signal strength. If the received signal strength satisfies (e.g., is greater than or equal to) the threshold signal strength, the RKE module 126 determines that there is a possible jamming attempt. For example, an expected received signal strength from the key fob 102 may be −100 dBm to −55 dBm depending on the distance of the key fob 102 from the vehicle 104. In such an example, the threshold signal strength may be −45 dBm. In response to determining that there is a possible jamming attempt, RKE module 126 (a) recynchronizes with RKE node 112 the key fob 102 when the vehicle 104 is next started (e.g., the ignition is switched to "ON") and/or (b) the sends an alert to the key fob 102 via the short-range wireless module 128. In response to receiving the alert from the vehicle 104, the communicator 116 of the key fob 102 illuminates the LED 110. The communicator 116 continues to illuminate the LED 110 until (a) a preset time period has elapsed (e.g., one minute), (b) the user presses a particular button combination (e.g., the unlock button 108*b* together with the lock button 108*a*), and/or (c) the RKE node 112 of the key fob 102 is resynchronized with the RKE module 126 of the vehicle 104.

To resynchronize the RKE node 112 of the key fob 102 with the RKE module 126 of the vehicle 104, the RKE module 126 of the vehicle 104 replaces the vehicle counter value with a randomly or pseudo-randomly generated number and changes the vehicle range value stored in the memory 132. The RKE module 126 of the vehicle 104 communicates the new vehicle counter value and the new vehicle range value to the RKE node 112 of the key fob 102 via the short-range wireless modules 114 and 128. The RKE node 112 of the key fob 102 replaces the range value 212 and the counter value 214 stored in the memory 120 with the new vehicle counter value and the new vehicle range value received from the vehicle 104.

Additionally or alternatively, in some examples, the RKE module 126 of the vehicle 104 stores the most recently received counter value 214 as the historical counter value in memory 132. In some examples, in response to the ignition being set to "ON," the RKE module 126 of the vehicle 104 retrieves, via the short-range wireless module 128, the counter value 214 from the RKE node 112 of the key fob 102. Alternatively, in some examples, in response to the ignition being set to "ON," the RKE module 126 of the vehicle 104 retrieves the counter value 214 from the RKE node 112 of the key fob 102 via circuitry of the key fob 102. In such examples, the RKE node 112 of the key fob 102 communicates with the RKE module 126 of the vehicle 104 via a separate transponder in the key fob 102 (e.g., near field communication (NFC), etc.) The RKE module 126 of the vehicle 104 compares the historical counter value with the counter value 214 from the key fob 102. When the historical counter value with the counter value 214 do not match, the RKE module 126 of the vehicle 104 resynchronizes with the RKE node 112 of the key fob 102. In some such examples, the RKE module 126 provides an alert via a center console display and/or a dashboard display of the vehicle 104.

Additionally or alternatively, in some examples, the RKE module 126 of the vehicle 104 sends a confirmation message 136 via the short-range wireless module 128 in response to receiving the RKE message 122 transmitted on the operating frequency. In such a manner, the confirmation message 136 is sent using a different frequency range and a different protocol than RKE message 122. In some such examples, the confirmation message 136 includes one or more parts the encrypted portion 218 of the RKE message 122. For example, the confirmation message 136 may include the range value 212 from the RKE message 122.

In such examples, after the communicator 116 sends the RKE message 122 to unlock the doors of the vehicle 104, the communicator 116 waits for the confirmation message 136. If the communicator 116 does not receive the confirmation message 136 within a threshold period of time (e.g., one second, five seconds, etc.), the communicator 116 provides an alert to the driver. In some examples, to alert the driver, the communicator 116 illuminates the LED 110. The communicator 116 continues to illuminate the LED 110 until (a) a preset time period has elapsed (e.g., one minute), (b) the user presses a particular button combination (e.g., the unlock button 108*b* together with the lock button 108*a*), and/or (c) the RKE node 112 of the key fob 102 is resynchronized with the RKE module 126 of the vehicle 104. Additionally, in some examples, the communicator 116 modifies subsequent RKE messages 122 to request that the RKE module 126 of the vehicle 104 resynchronize with the RKE node 112 of the key fob 102. The RKE message 122 remains modified until the RKE module 126 and the RKE node have been resynchronized. In some examples, the communicator 116 modifies the subsequent RKE messages 122 by setting the overflow value 208 to a particular value (e.g., 0×3, etc.). When the RKE module 126 of the vehicle 104 decrypts the encrypted portion 218 of the RKE message 122, in response to the RKE message 122 indicating (e.g., via the overflow value 208) a request to resynchronize, the RKE module 126 of the vehicle 104 resynchronizes with the RKE node 112 of the key fob 102 when the ignition is set to "ON."

Figure 3:
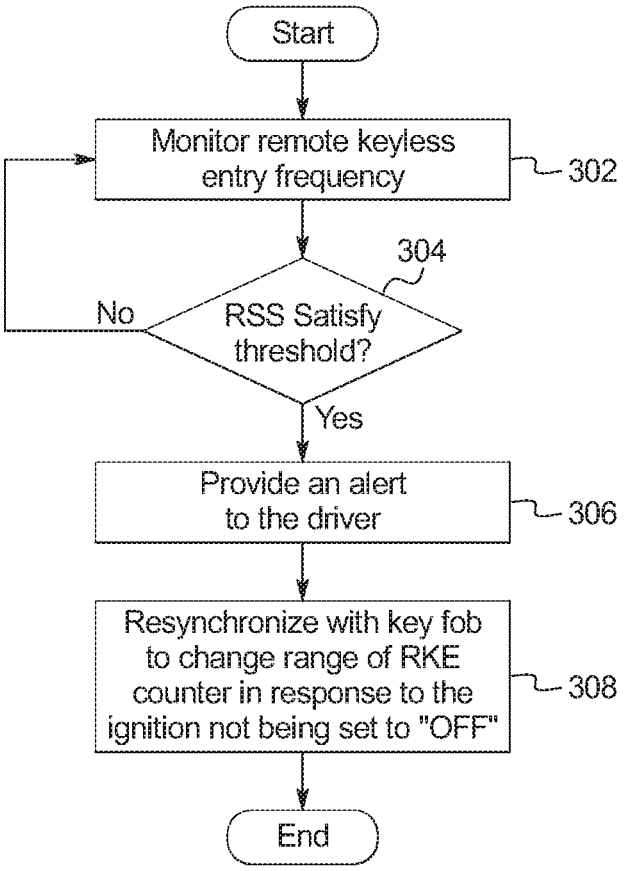
FIG. 3 is a flowchart of a method to detect and protect against the jam intercept and replay attack by detecting a jamming signal and resynchronizing the key fob of FIG. 1.

FIG. 3 is a flowchart of a method to detect and protect against the jam intercept and replay attack by detecting a jamming signal and resynchronizing the key fob 102 of FIG. 1. Initially, at block 302, the RKE module 126 of the vehicle 104 monitors the received signal strength of signals received by the receiver 134. At block 304, the RKE module 126 determines whether the received signal strength measured at block 302 satisfies (e.g., are greater than or equal to) the threshold signal strength. If the received signal strength satisfies the threshold signal strength, the method continues at block 306. Otherwise, if the received signal strength does not satisfy the threshold signal strength, the method returns to block 302.

At block 306, the RKE module 126 provides an alert to the driver. In some examples, the RKE module 126 provides the alert via the center console display and/or the dashboard display. At block 308, the RKE module 126 resynchronizes with the RKE node 112 of the key fob 102. To resynchronize, the RKE module 126 of the vehicle 104 replaces the vehicle counter value in the memory 132 with a randomly or pseudo-randomly generated number and changes the vehicle range value stored in the memory 132. The RKE module 126 of the vehicle 104 communicates the new vehicle counter value and the new vehicle range value to the RKE node 112 of the key fob 102 via the short-range wireless modules 114 and 128 or via circuitry of the key fob 102 when the key is inserted into the ignition. The RKE node 112 of the key fob 102 replaces the range value 212 and the counter value 214 stored in its memory 120 with the new vehicle counter value and the new vehicle range value received from the vehicle 104.

Figure 4:
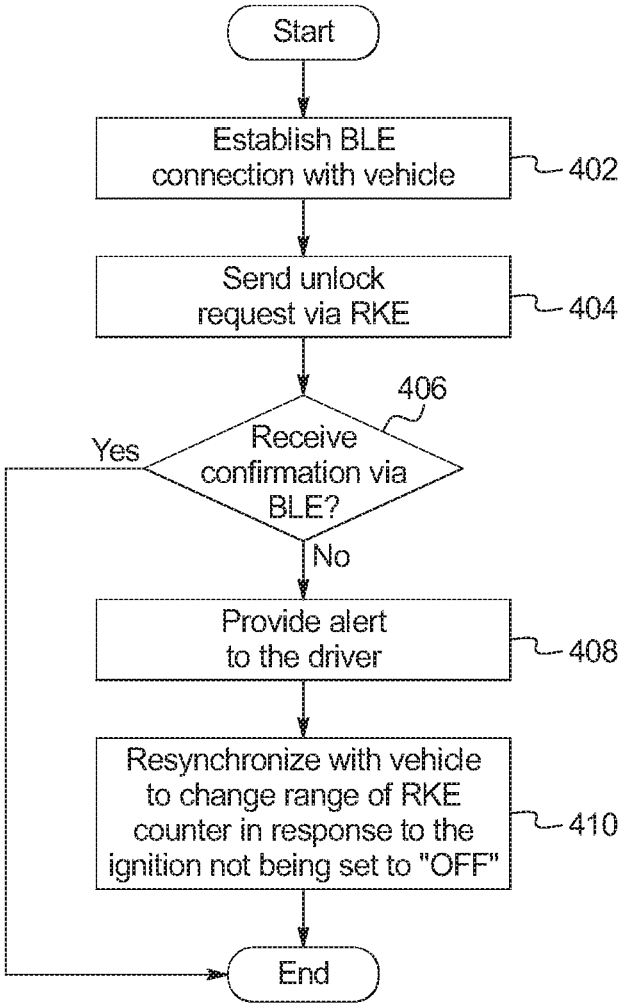
FIG. 4 is a flowchart of a method to detect and protect against the jam intercept and replay attack by confirming that the vehicle received the message sent by the key fob of FIG. 1.

FIG. 4 is a flowchart of a method to detect and protect against the jam intercept and replay attack by confirming that the vehicle 104 received the RKE message 122 sent by the key fob 102 of FIG. 1. Initially, at block 402, the communicator 116 of the key fob 102 establishes, via the short-range wireless module 114, a connection with the vehicle 104. At block 404, in response to activation of one of the buttons 108*a* and 108*b*, the communicator 116 generates RKE message 122 and sends the RKE message 122 via the RKE node 112. At block 406, the communicator 116 determines whether the confirmation message 136 has been received from the vehicle 104. If the confirmation message 136 has been received, the method ends. Otherwise, if the confirmation message 136 has not been received, the method continues to block 408. At block 408, the communicator 116 provides an alert to the driver. In some examples, to provide the alert, the communicator 116 illuminates the LED 110. At block 410, the communicator modifies the RKE message 122 to request that the RKE module 126 of the vehicle 104 resynchronize the range value 212 and the counter value 214.

Figure 5:
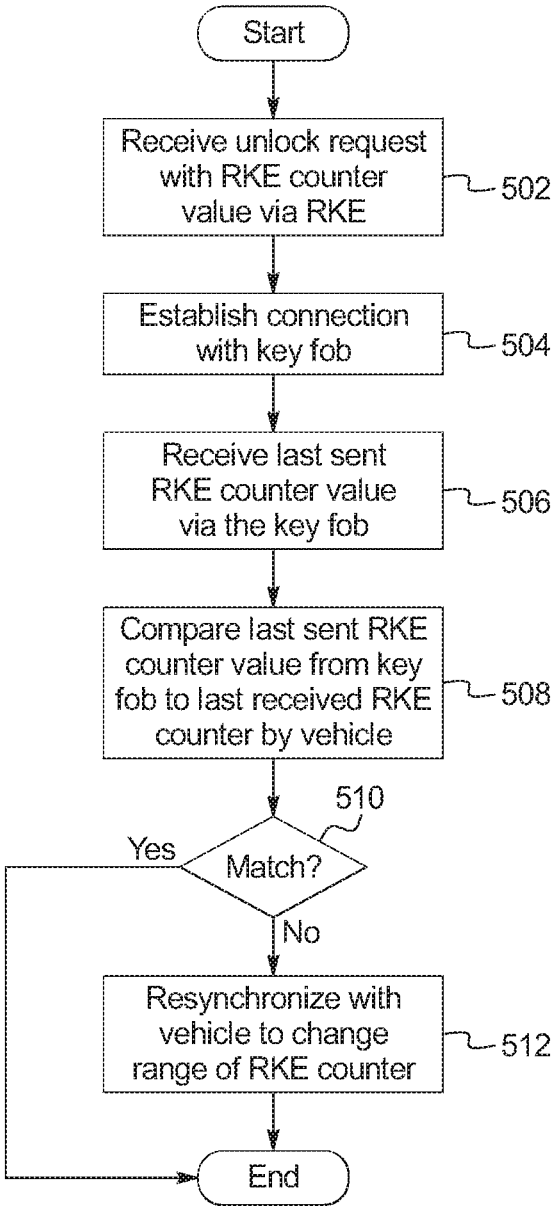
FIG. 5 is a flowchart of a method to detect and protect against the jam intercept and replay attack by confirming that the vehicle received the counter value sent by the key fob of FIG. 1.

FIG. 5 is a flowchart of a method to detect and protect against the jam intercept and replay attack by confirming that the vehicle 104 received the counter value 214 sent by the key fob 102 of FIG. 1. Initially, at block 502, the RKE module 126 of the vehicle 104 receives the RKE message 122. At block 504, the RKE module 126 establishes a short-range wireless connection with the key fob via the short-range wireless module 128. At block 506, the RKE module 126 requests and receives the last sent range value 212 and the last sent counter value 214 from the key fob 102 via the short-range wireless connection or the key fob when the key is inserted into the ignition. At block 508, the RKE module 126 compares the last sent range value 212 and the last sent counter value 214 received at block 506 to the historical range value and the historical counter value stored in memory 132. At block 510, the RKE module 126 determines whether (a) the range value 212 and historical range value match and (b) the counter value 214 and the historical counter value match. If the two values match, the method ends. Otherwise, if either of the values do not match, the method continues to block 512. At block 512, the RKE module 126 resynchronizes with the RKE node 112 of the key fob 102. To resynchronize, the RKE module 126 of the vehicle 104 replaces the vehicle counter value in the memory 132 with a randomly or pseudo-randomly generated number and changes the vehicle range value stored in the memory 132. The RKE module 126 of the vehicle 104 communicates the new vehicle counter value and the new vehicle range value to the RKE node 112 of the key fob 102 via the short-range wireless modules 114 and 128 or the key circuitry while the key is in the igntion. The RKE node 112 of the key fob 102 replaces the range value 212 and the counter value 214 stored in its memory 120 with the new vehicle counter value and the new vehicle range value received from the vehicle 104.

The flowcharts of FIGS. 3, 4, and 5 are representative of machine readable instructions stored in memory (such as the memory 120 and 132 of FIG. 1) that comprise one or more programs that, when executed by a processor (such as the processors 118 and 130 of FIG. 1), cause the vehicle 104 to implement the example RKE module 126 of FIG. 1 and the key fob 102 to implement the communicator 116 of FIG. 1. Further, although the example program(s) is/are described with reference to the flowchart illustrated in FIGS. 3, 4, and 5, many other methods of implementing the example RKE module 126 and/or the example communicator 116 may alternatively be used. For example, the order of execution of the blocks may be changed, and/or some of the blocks described may be changed, eliminated, or combined.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A key fob comprising:

first and second transceivers that respectively communicate via differing first and second frequency bands; and a communicator to:

responsive to activation of a first button, send a first message to a vehicle via the first transceiver; and responsive to not receiving a second message from the vehicle via the second transceiver:

provide an alert; and send a third message to the vehicle including a resynchronization request via the first transceiver.

2. The key fob of claim 1, wherein the first frequency band includes at least one of 315 MHz or 433.92 MHz, and wherein the second frequency band includes 2.4 GHz.

3. The key fob of claim 1, wherein the first message includes a button command, a discrimination value, a first range value, an overflow value, and a counter value.

4. The key fob of claim 3, wherein the discrimination value, the first range value, the overflow value, and the counter value are encrypted by the communicator using an encryption key.

5. The key fob of claim 3, wherein:

the communicator is to generate the resynchronization request by modifying the overflow value; and responsive to the resynchronization request, a remote keyless entry module of the vehicle is to resynchronize the first range value and the counter value.

6. The key fob of claim 1, including a light emitting diode, and wherein to provide the alert, the communicator is to illuminate the light emitting diode.

7. The key fob of claim 6, wherein the communicator is to stop illuminating the light emitting diode after a period of time.

8. The key fob of claim 6, wherein the communicator is to stop illuminating the light emitting diode in response to receiving input from a combination of the first button and a second button.

9. The key fob of claim 6, wherein the communicator is to stop illuminating the light emitting diode in response to receiving a new range value and a new counter value from a remote keyless entry module of the vehicle.

10. A method for a key fob comprising:

establishing a connection to a vehicle, via a short-range wireless module, using a first frequency band;

sending a first message to the vehicle, via a remote keyless entry node tuned to communicate via a second frequency band, in response to activation of a first button, the first and second frequency bands being different; and in response to not receiving, from the vehicle, a second message responding to the first message via the short-range wireless module:

providing, via a processor, an alert; and sending a third message to the vehicle including a resynchronization request via the remote keyless entry node.

11. The method of claim 10, wherein the first frequency band includes at least one of 315 MHz or 433.92 MHz, and wherein the second frequency band includes 2.4 GHz.

12. The method of claim 10, wherein sending the first message includes generating the first message to include a button command, a discrimination value, a first range value, an overflow value, and a counter value.

13. The method of claim 12, wherein generating the first message includes encrypting, using an encryption key, the discrimination value, the first range value, the overflow value, and the counter value.

14. The method of claim 12, wherein sending the third message includes generating the resynchronization request by modifying the overflow value and including resynchronizing, via a remote keyless entry module of the vehicle, the first range value and the counter value.

15. The method of claim 10, wherein the key fob includes a light emitting diode, and wherein providing the alert includes illuminating the light emitting diode.

16. The method of claim 15, including turning off the light emitting diode after a period of time.

17. The method of claim 15, including turning off the light emitting diode in response to receiving input from a combination of the first button and a second button.

18. The method of claim 15, including turning off the light emitting diode in response to receiving a new range value and a new counter value from a remote keyless entry module of the vehicle.

19. A non-transitory computer readable medium comprising instructions that, when executed, cause a key fob to:

establish a connection to a vehicle, via a first transceiver, using a first frequency band;

send a first message to the vehicle, via a second transceiver tuned to communicate via a second frequency band, in response to activation of a first button, the first and second frequency bands being different; and in response to not receiving, from the vehicle via the first transceiver after a threshold period of time, a second message that includes a value in an encrypted portion of the first message:

provide an alert; and send a third message to the vehicle including a resynchronization request via the second transceiver.

20. The non-transitory computer readable medium of claim 19, wherein:

the resynchronization request is a first resynchronization request; and the instructions, when executed, further cause the key fob to receive a fourth message including a second resynchronization request from the vehicle via the second transceiver.

21. The non-transitory computer readable medium of claim 20, wherein the instructions, when executed, further cause the key fob to resynchronize with a remote keyless entry module of the vehicle.

22. The key fob of claim 1, wherein:

the resynchronization request is a first resynchronization request; and the communicator is to, responsive to receiving a fourth message including a second resynchronization request from the vehicle via the second transceiver, resynchronize with the vehicle.

23. The method of claim 10, wherein the resynchronization request is a first resynchronization request and further comprising, in response to receiving a fourth message including a second resynchronization request from the vehicle via the remote keyless entry node, resynchronizing with the vehicle.

* * * * *